US010597216B2

(12) United States Patent
Imai et al.

(10) Patent No.: US 10,597,216 B2
(45) Date of Patent: Mar. 24, 2020

(54) PACKING MEMBER

(71) Applicant: FUJI XEROX CO., LTD., Tokyo (JP)

(72) Inventors: Seiya Imai, Kanagawa (JP); Yohei Suzuki, Kanagawa (JP); Yasunori Uemura, Kanagawa (JP); Ryoji Sugimoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/116,936

(22) Filed: Aug. 30, 2018

(65) Prior Publication Data

US 2019/0144191 A1 May 16, 2019

(30) Foreign Application Priority Data

Nov. 15, 2017 (JP) ..... 2017-219975

(51) Int. Cl.
*B65D 81/05* (2006.01)
*G03G 21/18* (2006.01)
*B65D 85/68* (2006.01)

(52) U.S. Cl.
CPC ..... *B65D 81/054* (2013.01); *B65D 81/058* (2013.01); *B65D 85/68* (2013.01); *G03G 21/181* (2013.01); *B65D 2585/689* (2013.01); *G03G 2215/00375* (2013.01)

(58) Field of Classification Search
CPC .... B65D 81/054; B65D 85/68; B65D 81/058; B65D 85/689; G03G 21/181; G03G 2215/00375
USPC ..... 206/583, 586, 588, 591, 523, 592, 485, 206/488–490, 521
See application file for complete search history.

(56) References Cited

U.S. PATENT DOCUMENTS 3,853,221 A * 12/1974 Boyd ..... B65D 1/36 206/523
4,114,761 A * 9/1978 Kleiner ..... B65D 81/027 206/591
4,119,204 A * 10/1978 Peckar ..... B65D 81/133 206/480
4,244,471 A * 1/1981 Plante ..... B65D 19/0018 206/386
5,871,194 A * 2/1999 Morley ..... B65D 59/00 248/345.1
6,938,773 B1 * 9/2005 Sotto ..... B65D 81/107 206/523
7,648,750 B2 * 1/2010 Sattora ..... B65D 81/113 206/586
7,743,922 B2 * 6/2010 Pitt ..... B65D 21/023 206/521

(Continued)

FOREIGN PATENT DOCUMENTS

JP 2002-46778 2/2002
JP 2009-214900 9/2009

*Primary Examiner* — Chun Hoi Cheung
(74) *Attorney, Agent, or Firm* — JCIPRNET

(57) ABSTRACT

A packing member attached to an article to be packed, which is accommodated in a package box, to absorb an impact applied to the article, including: a first supporting part; a second supporting part; and a shock absorbing member connected to the first supporting part and the second supporting part. One of the first supporting part and the second supporting part is disposed so as to be partially in contact with the article in a state in which an impact is not applied. When an impact is applied, the shock absorbing member deforms to absorb the impact.

15 Claims, 14 Drawing Sheets

(56) References Cited

U.S. PATENT DOCUMENTS

| | | | | |
|---|---|---|---|---|
| 9,016,475 | B2 * | 4/2015 | Chen | B65D 81/022 206/485 |
| 2005/0155890 | A1 * | 7/2005 | Manuel | B65D 81/113 206/523 |
| 2009/0260329 | A1 * | 10/2009 | Ochoa | H01L 21/67369 53/473 |
| 2010/0072096 | A1 * | 3/2010 | Wu | B65D 81/053 206/453 |
| 2010/0276331 | A1 * | 11/2010 | Fan | B65D 5/5069 206/591 |

* cited by examiner

PACKING MEMBER

CROSS-REFERENCE TO RELATED APPLICATIONS

This application is based on and claims priority under 35 USC 119 from Japanese Patent Application No. 2017-219975 filed Nov. 15, 2017.

BACKGROUND

Technical Field

The present invention relates to a packing member.

SUMMARY

According to an aspect of the invention, there is provided a packing member attached to an article to be packed, which is accommodated in a package box, to absorb an impact applied to the article. The packing member includes: a first supporting part; a second supporting part; and a shock absorbing member connected to the first supporting part and the second supporting part. One of the first supporting part and the second supporting part is disposed so as to be partially in contact with the article in a state in which an impact is not applied. When an impact is applied, the shock absorbing member deforms to absorb the impact.

BRIEF DESCRIPTION OF THE DRAWINGS

Exemplary embodiment of the present invention will be described in detail based on the following figures, wherein.

DETAILED DESCRIPTION

Figure 1A:
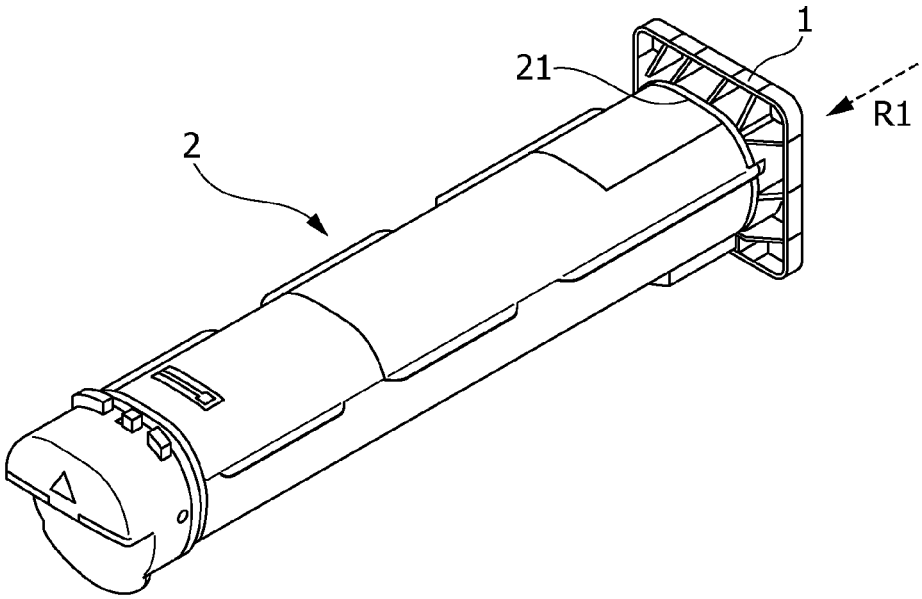
FIG. 1A is a perspective view of a packing member attached to a developer container.

Referring to the drawings, the present invention will be described in more detail below using an exemplary embodiment and examples. Note that the present invention is not limited to the exemplary embodiment and examples.

It should be noted that the drawings are schematic illustration, and the dimensional ratios etc., are different from those in actuality. Illustration of components other than those needed for understanding is omitted where appropriate.

Exemplary Embodiment (1) Configuration of Packing Member

Figure 1B:
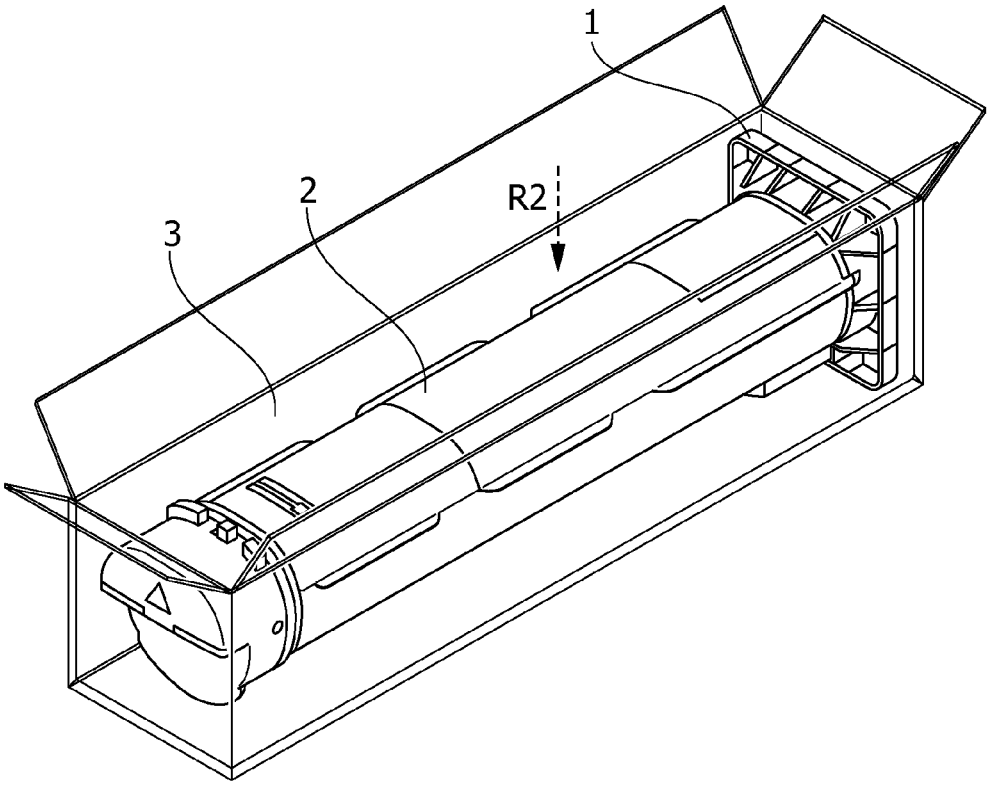
FIG. 1B is a perspective view showing a state in which the developer container to which the packing member is attached is accommodated in a package box.
Figure 2:
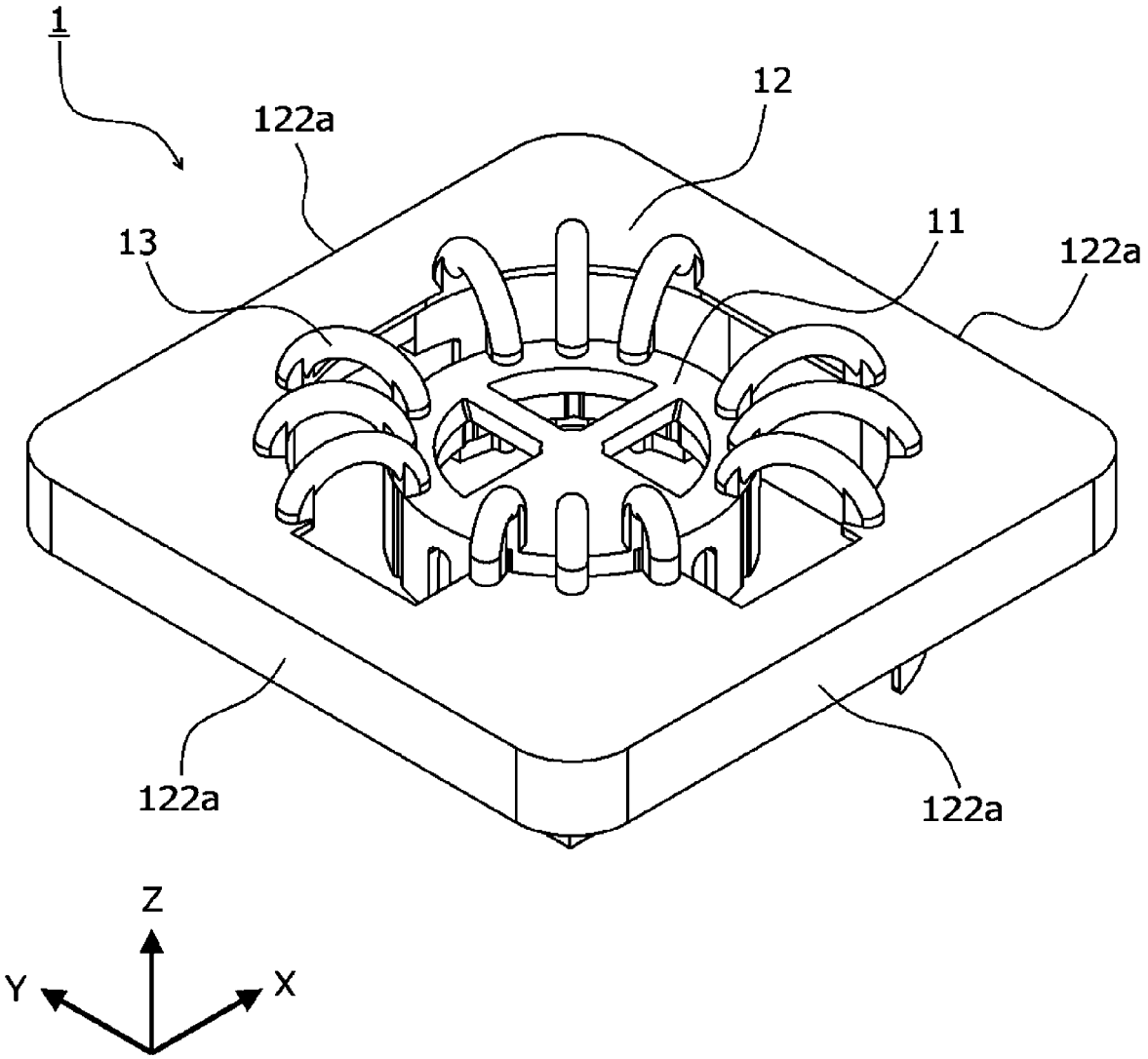
FIG. 2 is a perspective view showing the exterior of the packing member.
Figure 3:
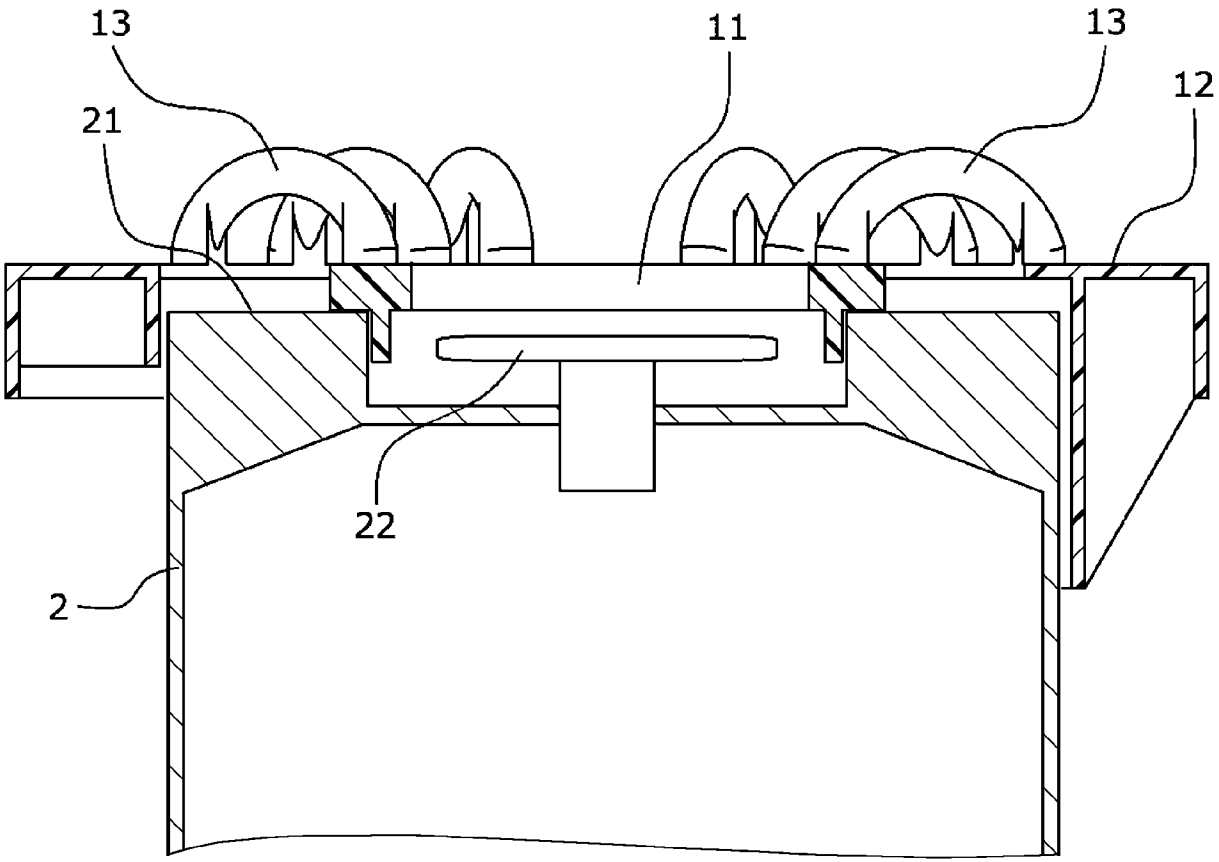
FIG. 3 is a schematic sectional view of the packing member attached to the developer container.
Figure 4A:
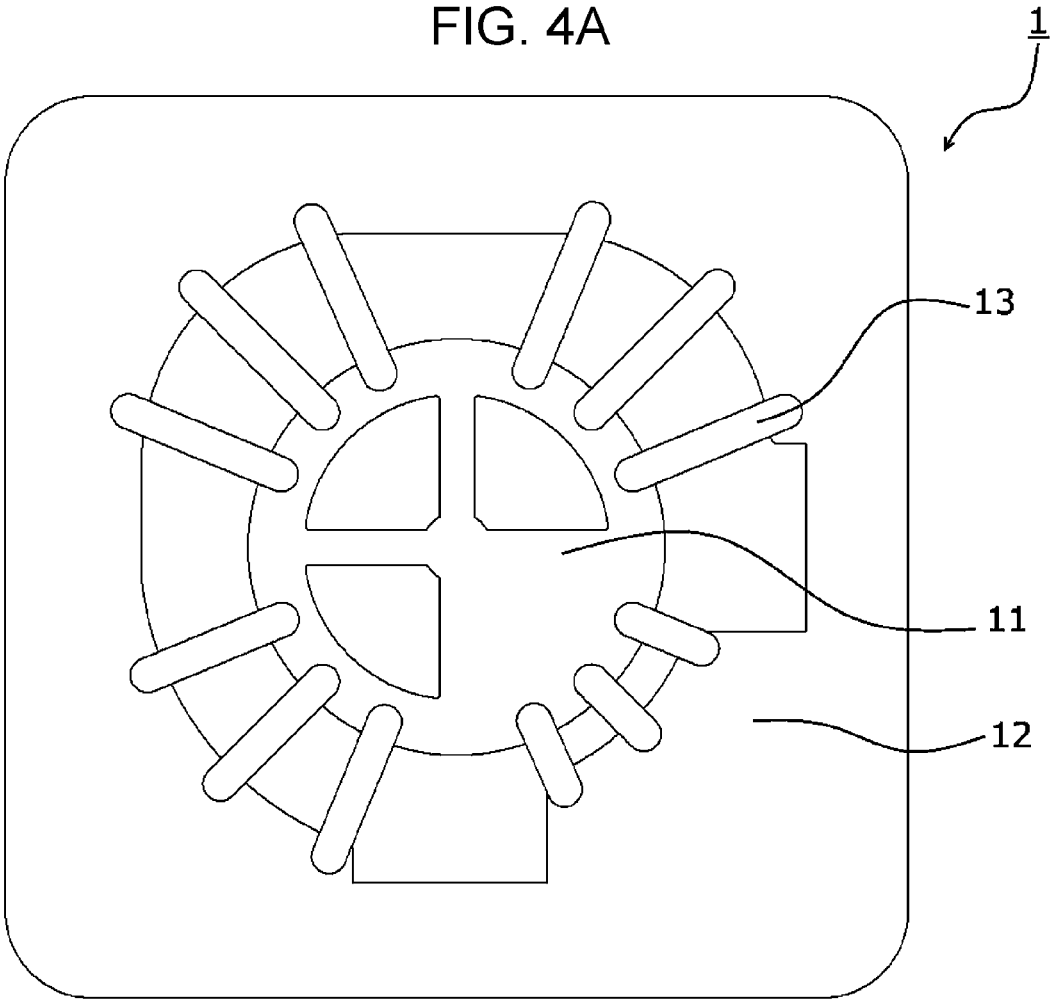
FIG. 4A is a plan view of the packing member as viewed from the side opposite to the side attached to the developer container.
Figure 4B:
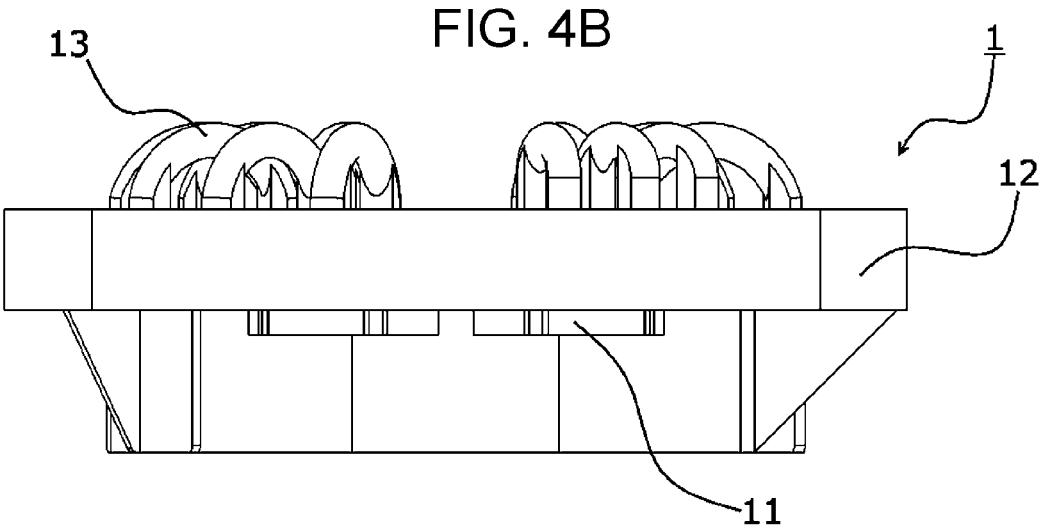
FIG. 4B is a side view of the packing member.
Figure 5A:
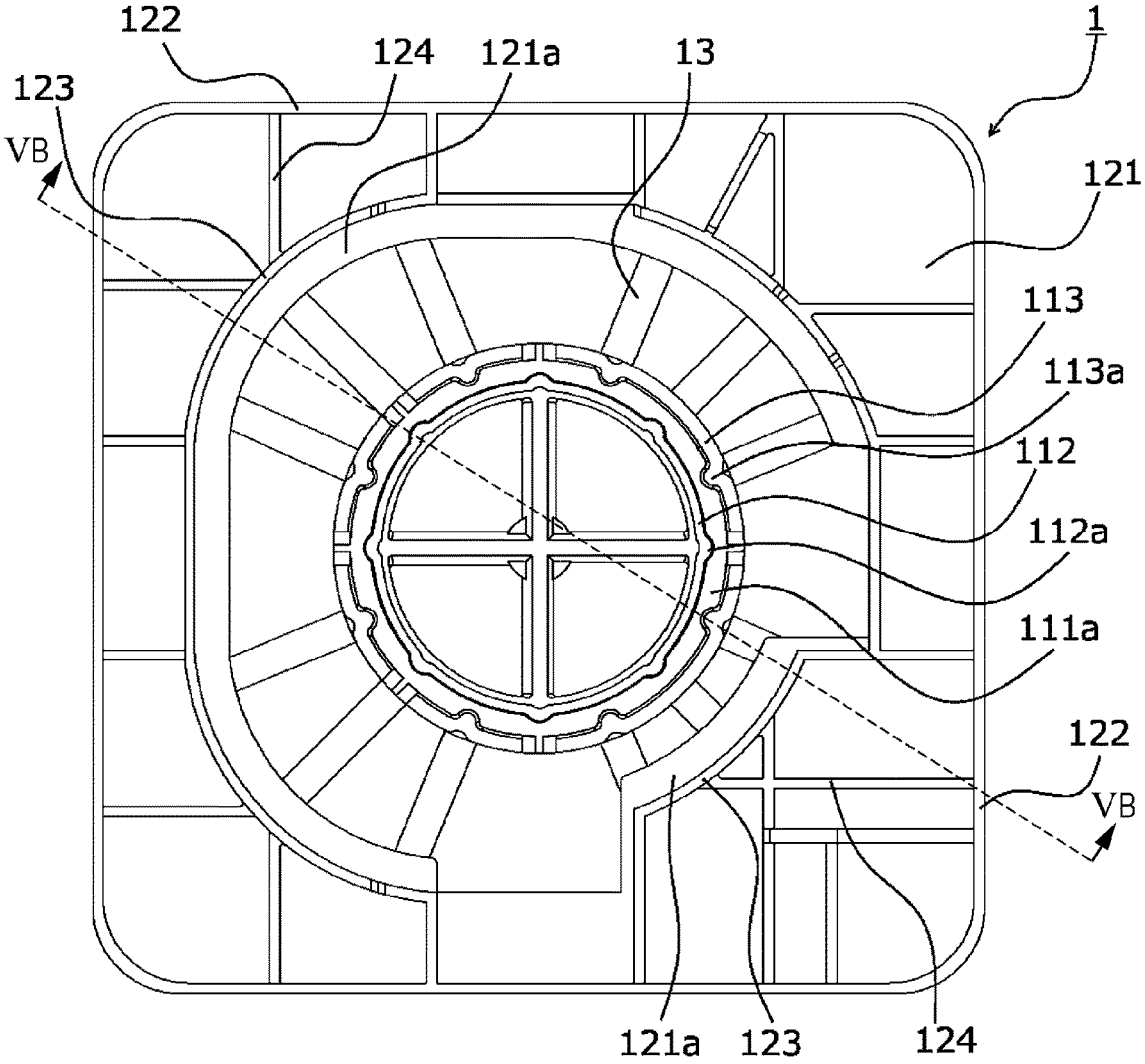
FIG. 5A is a plan view of the packing member as viewed from the side attached to the developer container.
Figure 5B:
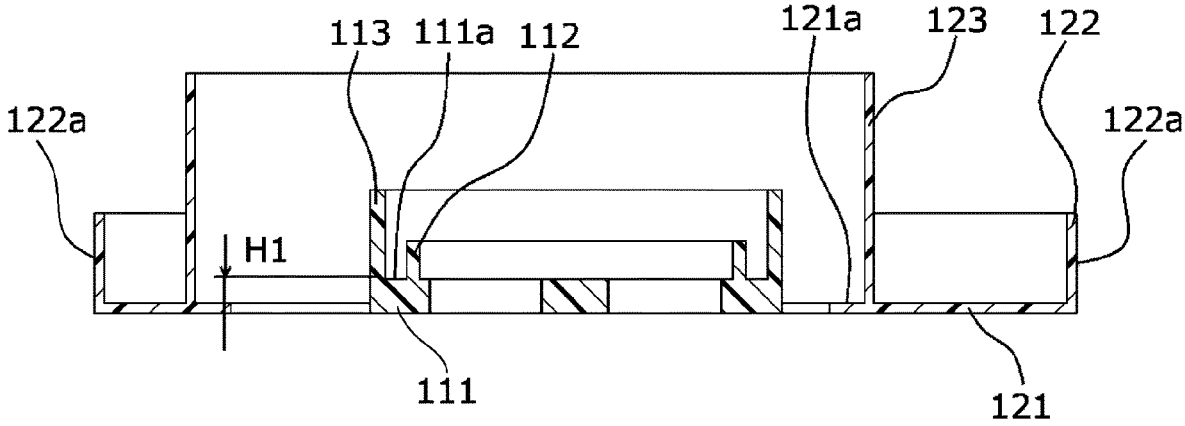
FIG. 5B is a schematic sectional view of the relevant part taken along line VB-VB in FIG. 5A, in which shock absorbing members are not shown.
Figure 6A:
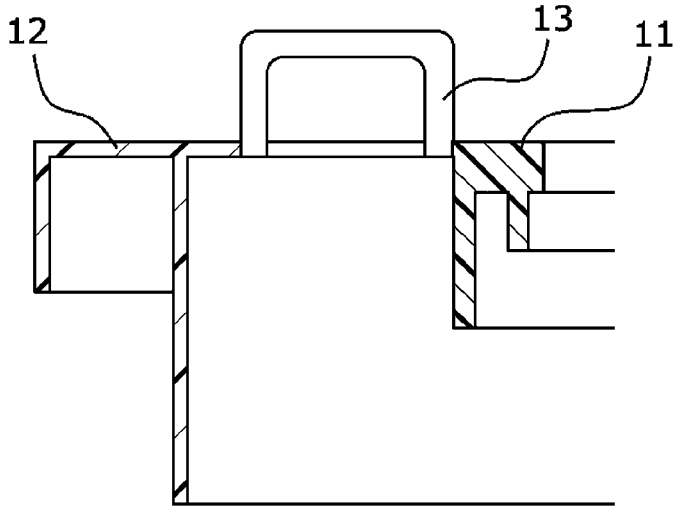
FIGS. 6A to 6C show the shapes of the shock absorbing member.
Figure 6B:
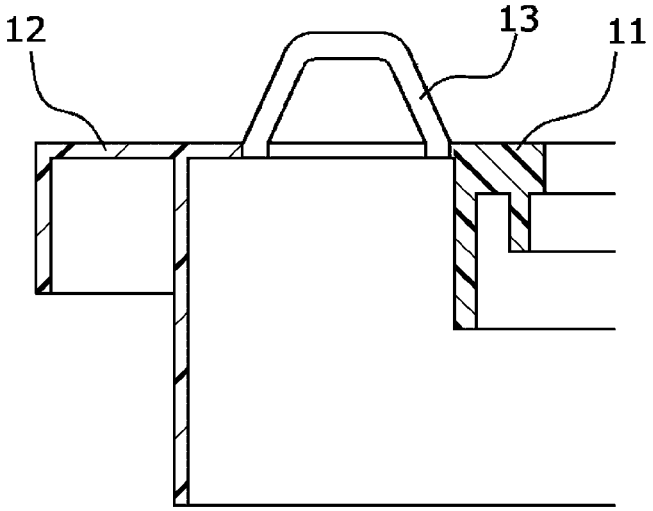
Figure 6C:
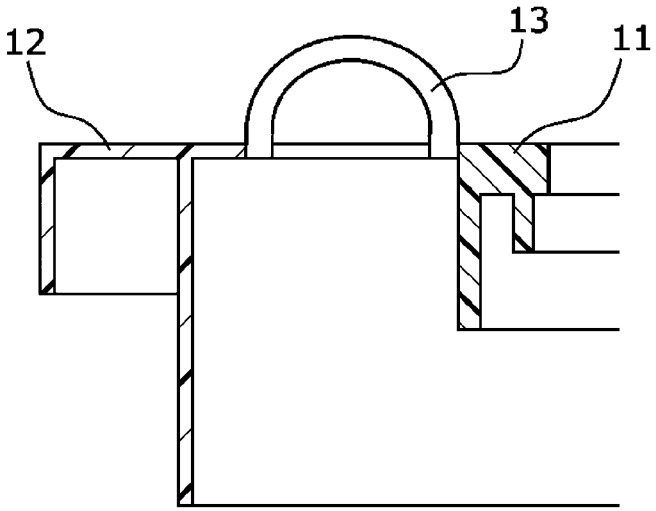
Figure 7A:
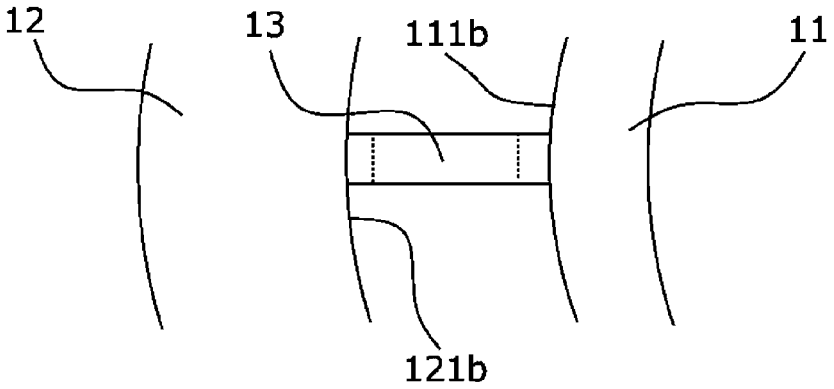
FIGS. 7A and 7B show a connecting structure between the shock absorbing member and a first supporting part and a second supporting part.
Figure 7B:
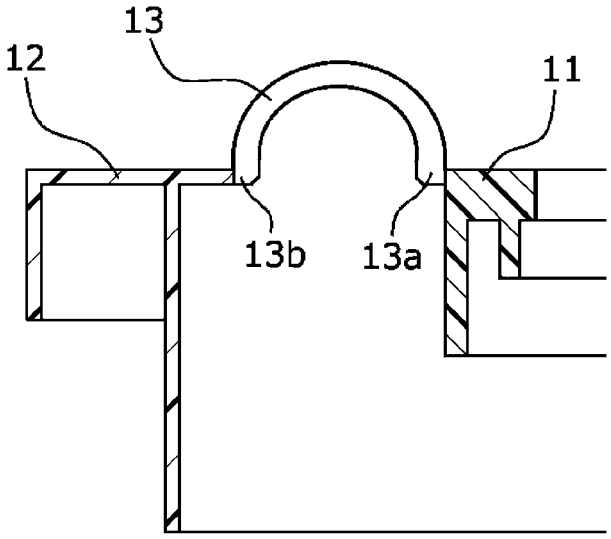

FIG. 1A is a perspective view of a packing member 1 attached to a developer container 2, and FIG. 1B is a perspective view showing a state in which the developer container 2 to which the packing member 1 is attached is accommodated in a package box 3. FIG. 2 is a perspective view showing the exterior of the packing member 1. FIG. 3 is a schematic sectional view of the packing member 1 attached to the developer container 2. FIG. 4A is a plan view of the packing member 1 as viewed from the side opposite to the side attached to the developer container 2, and FIG. 4B is a side view of the packing member 1. FIG. 5A is a plan view of the packing member 1 as viewed from the side attached to the developer container 2, and FIG. 5B is a schematic sectional view of the relevant part taken along line VB-VB in FIG. 5A, in which shock absorbing members 13 are not shown. FIGS. 6A to 6C show the shapes of the shock absorbing member 13. FIGS. 7A and 7B show a connecting structure between the shock absorbing member 13 and a first supporting part 11 and a second supporting part 12.

The configuration of the packing member 1 will be described below with reference to the drawings.

(1.1) Overall Configuration of Packing Member

As shown in FIG. 1 (in which the package box 3 is shown as a semitransparent box), the packing member 1 is attached to the developer container 2, which is an example of an article to be packed, to fix the position of the developer container 2 in the package box 3.

Inside the package box 3, the packing member 1 is located between the developer container 2 and the package box 3 to absorb an impact applied from the outside to the package box 3 to protect the developer container 2.

The developer container 2 is a cylindrical container accommodating developer (toner including carrier) of a specific color. The developer container 2 has, near one end thereof, an attachment part 21 to which the packing member 1 is attached. The attachment part 21 is formed as a tubular member as a whole and has a coupling 22 (see FIG. 3) that receives rotational driving force from an image forming apparatus, to which the developer container 2 is attached, at the center thereof. The attachment part 21 has a tubular projecting wall 211 projecting so as to surround the coupling 22. A developer discharge port and a shutter device (not shown) for opening and closing the discharge port are provided in the outer circumference of the attachment part 21. Furthermore, a storage medium (memory: not shown) is provided on a portion of the outer circumference of the attachment part 21. The memory stores identification information, use history, developer level of the developer container 2, etc. The image forming apparatus to which the developer container 2 is attached reads information from and writes information in the memory.

The developer container 2 is removably attached to the image forming apparatus (not shown). When the developer container 2 is attached to the image forming apparatus, and when an image forming operation is performed, the developer container 2 discharges the developer to a developing device (not shown) that forms an image. When the developer in the developer container 2 is used up, a user removes the developer container 2 from the image forming apparatus to replace with a new one.

At this time, the user takes out a new developer container 2, to which a packing member 1 is attached, from the package box 3 and removes the packing member 1. Then, the user sets the developer container 2 in the image forming apparatus, attaches (see arrow R1 in FIG. 1A) the packing member 1 to a used developer container 2 removed from the image forming apparatus, and puts the developer container 2 in the package box 3 (see arrow R2 in FIG. 1B), as shown in FIGS. 1A and 1B.

(1.2) Configuration of Packing Member

The packing member 1 is basically formed of the first supporting part 11, the second supporting part 12, and the shock absorbing members 13. The first supporting part 11 is formed at the center of the packing member 1 and supports the periphery of the coupling 22 (see FIG. 3) of the attachment part 21 of the developer container 2. The second supporting part 12 is formed on the outer side (X and Y directions) of the first supporting part 11. As a result of the exterior part (an outer surface 122*a*) of the packing member 1 being fitted in the inner surface of the package box 3, the packing member 1 is secured in the package box 3. The shock absorbing members 13 are connected to the first supporting part 11 and the second supporting part 12. When an impact is applied, the shock absorbing members 13 deform to absorb the impact.

As shown in FIGS. 4A to 5B, the first supporting part 11 is formed as a tubular member as a whole, which has a circular shape in plan view, at the center of the packing member 1. More specifically, the first supporting part 11 includes: a base portion 111, which has a circular shape in plan view; a first projecting portion 112, which has a tubular shape as a whole and projects in the Z direction from the inner side of the base portion 111 in the X-Y direction; and a second projecting portion 113, which projects from the outer side of the base portion 111 in the X-Y direction so as to face the first projecting portion 112.

As shown in FIG. 5A, the first projecting portion 112 has projections 112*a* projecting outward from a side wall thereof, and the second projecting portion 113 has projections 113*a* projecting inward from a side wall thereof. When the attachment part 21 of the developer container 2 is attached to the packing member 1, the projections 112*a* and the projections 113*a* nip the projecting wall 211 in the thickness direction (X-Y direction), preventing the developer container 2 from easily coming off.

As shown in FIGS. 4A to 5B, the second supporting part 12 is formed on the periphery of the packing member 1, in the shape of a frame having a rectangular outer circumference and a circular inner circumference in plan view. More specifically, the second supporting part 12 includes a base portion 121, a third projecting portion 122 projecting in the Z direction from the outer edge of the base portion 121 in the X-Y direction, and a fourth projecting portion 123 projecting in the Z direction from the inner edge of the base portion 121 in the X-Y direction. The third projecting portion 122 and the fourth projecting portion 123 are reinforced by reinforcing ribs 124 as necessary.

The outer surface 122*a* of the third projecting portion 122 constitutes the exterior part of the packing member 1. When the outer surface 122*a* of the third projecting portion 122 and the inner surface of the package box 3 accommodating the developer container 2 and the packing member 1 attached thereto are fitted together, the packing member 1 is secured in the package box 3 in a direction intersecting the direction in which the developer container 2 is attached (developer-container attaching direction).

In the thus-configured first supporting part 11 and the second supporting part 12, the base portions 111 and 121 have surfaces 111*a* and 121*a* on the side attached to the developer container 2. The surface 111*a* of the base portion 111 of the first supporting part 11 and the surface 121*a* of the base portion 121 of the second supporting part 12 have different heights (see H1 in FIG. 5B) in the developer-container attaching direction (Z direction). Hence, when the developer container 2 is attached to the packing member 1, the distance between a distal end portion 211*a* of the projecting wall 211 and the surface 111*a* and the distance between a distal end portion 21*a* of the attachment part 21 (see FIG. 8) and the surface 121*a* are different from each other. The reason for this configuration will be described below.

There are multiple shock absorbing members 13, which have the shape of bridges connecting between the first supporting part 11 and the second supporting part 12. More specifically, as shown in FIGS. 7A and 7B, each shock absorbing member 13 has a first end 13*a* connected to an outer end 111*b* of the base portion 111 of the first supporting part 11 and a second end 13*b* connected to an inner end 121*b* of the base portion 121 of the second supporting part 12. The shock absorbing members 13 are provided so as to form bridges protruding toward the side opposite to the side to which the developer container 2 is attached, in the developer-container attaching direction (Z direction).

Because the first supporting part 11 and the second supporting part 12 are connected to each other via the shock absorbing members 13, when one of the first supporting part 11 and the second supporting part 12 is subjected to an impact in the developer-container attaching direction (Z direction), the first supporting part 11 and the second supporting part 12 move relative to each other via the shock absorbing members 13 to absorb the impact.

The shock absorbing members 13 may have a rectangular shape, a trapezoidal shape, or a substantially U shape, as shown in FIGS. 6A to 6C. The trapezoidal shape provides a better impact-absorbing performance than the rectangular shape, and the substantially U shape provides a better impact-absorbing performance than the trapezoidal shape.

In this exemplary embodiment, as shown in FIGS. 4A to 5B, etc., twelve shock absorbing members 13 are formed so as to extend in the radial direction to connect the first supporting part 11 and the second supporting part 12. The number of the shock absorbing members 13 can be selected according to the size, weight, and the like of the developer container 2 attached to the packing member 1, so that the impact applied when the developer container 2 accommodated in the package box 3 is dropped can be absorbed.

In the thus-configured packing member 1, the first supporting part 11, the second supporting part 12, and the shock absorbing members 13 are formed of synthetic resin as a single component by injection molding. Although the type of the synthetic resin is not specifically limited, in this exemplary embodiment, low-density polyethylene (LDPE) is used from the standpoint that it is not broken when subjected to an impact, and it exhibits high impact-absorbing performance.

Furthermore, from the standpoint of suppressing formation of a burr in the injection molding using molds, as shown in FIGS. 7A and 7B, it is desirable to form the shock absorbing members 13 such that the first end 13*a* is connected to the outer end 111*b* of the base portion 111 of the first supporting part 11 and the second end 13*b* is connected to the inner end 121*b* of the base portion 121 of the second supporting part 12. This configuration minimizes formation of a burr on the outer end 111*b* of the base portion 111 and the inner end 121*b* of the base portion 121, which is caused when molds having a so-called press-cutting structure are used.

(2) Attachment of Packing Member

Figure 8:
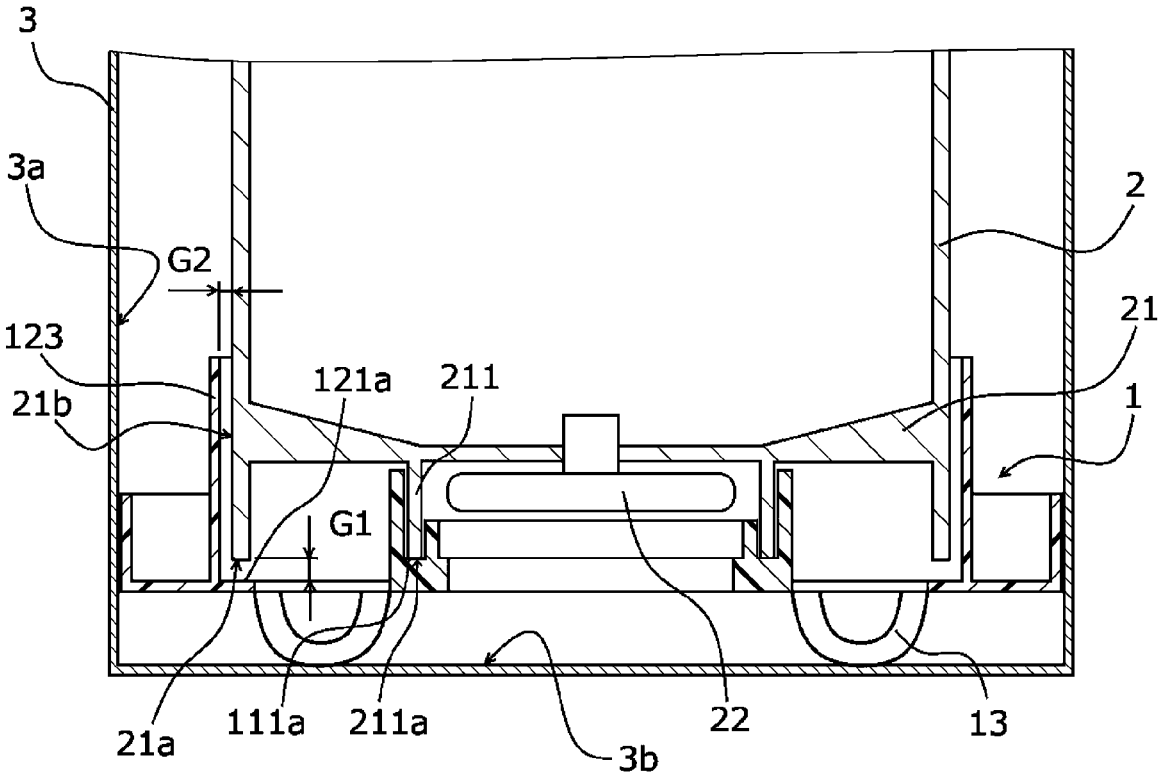
FIG. 8 is a plan view showing a state in which the developer container to which the packing member is attached is accommodated in the package box.
Figure 9:
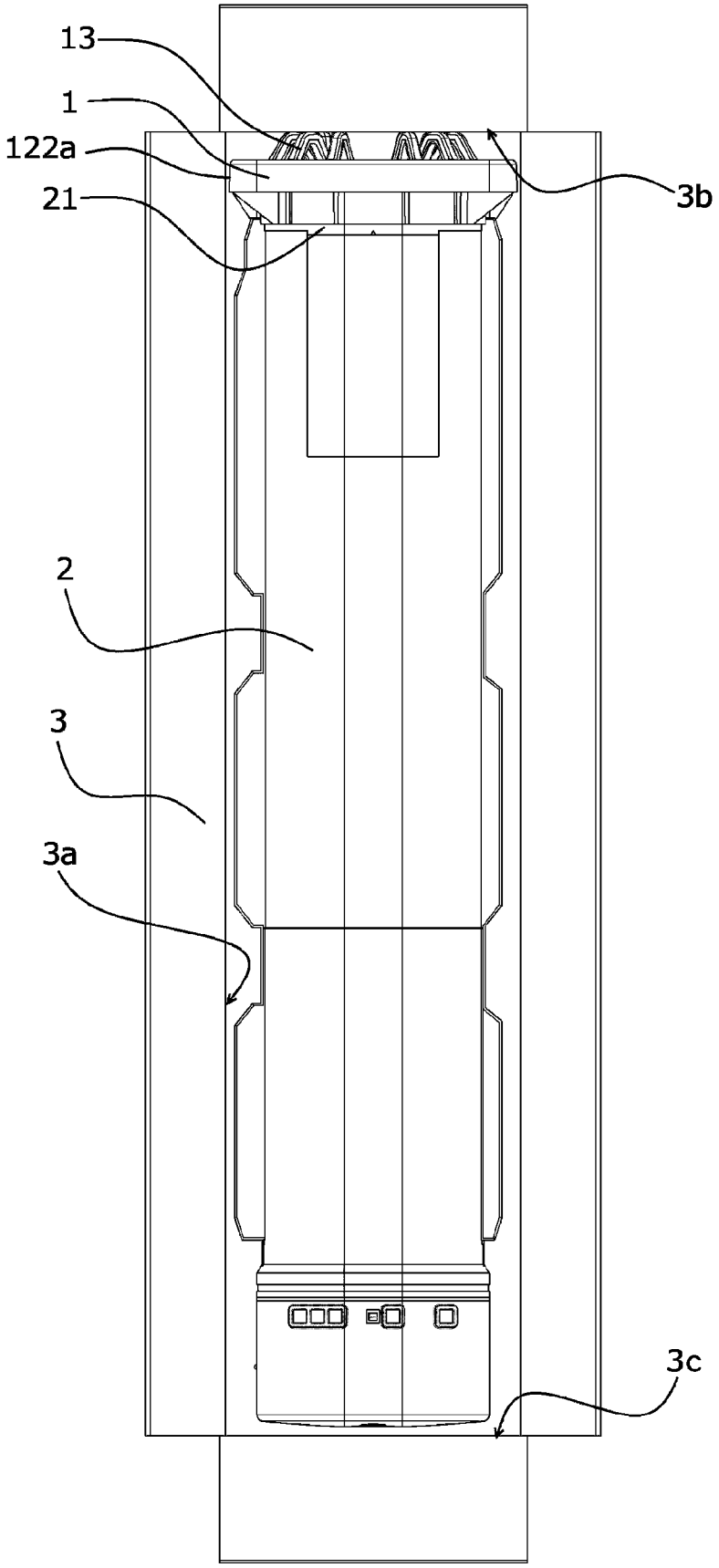
FIG. 9 is a schematic sectional view of the packing member to which an attachment part of the developer container is attached.
Figure 10A:
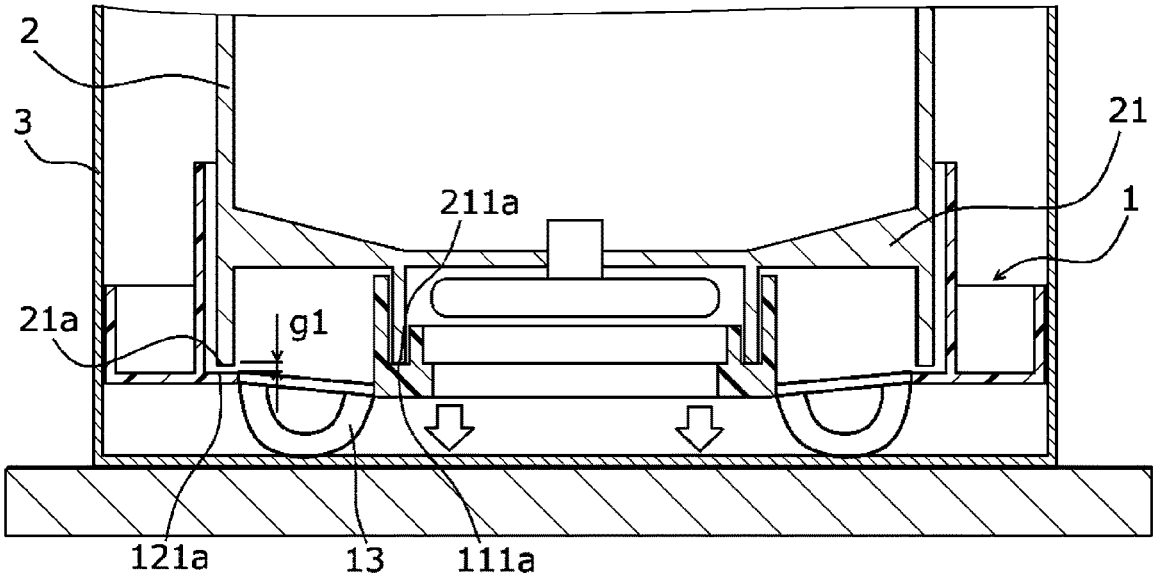
FIG. 10A shows how the packing member absorbs an impact applied in the direction in which developer container is attached.
Figure 10B:
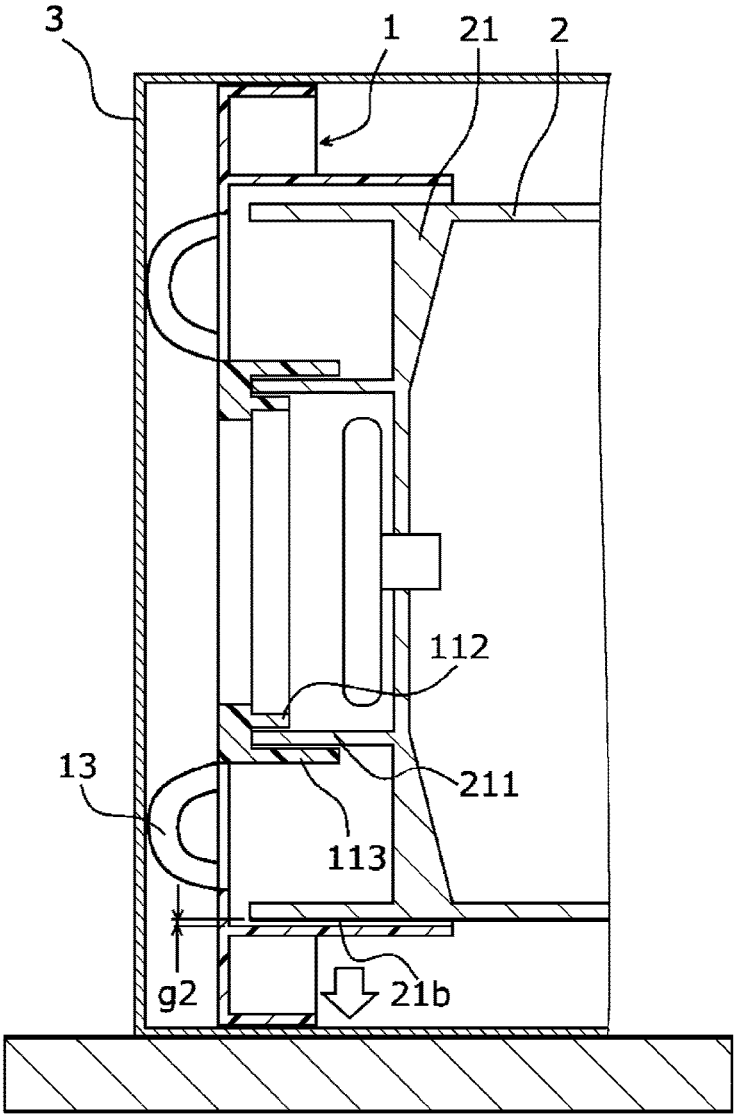
FIG. 10B shows how the packing member absorbs an impact applied in a direction intersecting the direction in which the developer container is attached.

FIG. 8 is a plan view showing a state in which the developer container 2 to which the packing member 1 is attached is accommodated in the package box 3. FIG. 9 is a schematic sectional view of the packing member 1 to which the attachment part 21 of the developer container 2 is attached. FIG. 10A shows how the packing member 1 absorbs an impact applied in the developer-container attaching direction, and FIG. 10B shows how the packing member 1 absorbs an impact applied in a direction intersecting the developer-container attaching direction. Referring to these drawings, how the packing member 1 absorbs an impact will be described.

As shown in FIG. 8, the developer container 2 is accommodated in the package box 3 with the packing member 1 being attached to the attachment part 21. The developer container 2 accommodated in the package box 3 is secured in a direction (X-Y direction) intersecting the direction in which the packing member 1 is attached as a result of the outer surface 122*a* of the second supporting part 12 of the packing member 1 and the inner surface 3*a* of the package box 3 being fitted together. Furthermore, the developer container 2 accommodated in the package box 3 is secured in the direction in which the packing member 1 is attached (Z direction) as a result of one end, i.e., the shock absorbing members 13, being in contact with the bottom surface 3*b* of the package box 3 and the other end being in contact with the other bottom surface 3*c* of the package box 3.

As shown in FIG. 9, the surface 111*a* of the base portion 111 of the first supporting part 11 is in contact with the distal end portion 211*a* of the projecting wall 211 of the attachment part 21 of the developer container 2 in the developer-container attaching direction. The projecting wall 211 of the attachment part 21 is sandwiched between the projections 112*a* of the first projecting portion 112 and the projections 113*a* of the second projecting portion 113 of the first supporting part 11, thus being positioned.

There is a gap G1 between the surface 121*a* of the base portion 121 of the second supporting part 12 and the distal end portion 21*a* of the attachment part 21 of the developer container 2 so that they do not touch each other. There is a gap G2 between an outer surface 21*b* of the attachment part 21 and the fourth projecting portion 123 of the second supporting part 12 so that they do not touch each other. As a result of the outer surface 122*a* of the third projecting portion 122 and the inner surface 3*a* of the package box 3 being fitted together, the developer container 2 is secured in the package box 3 in a direction (X-Y direction) intersecting the developer-container attaching direction.

When the package box 3 accommodating the developer container 2 to which the packing member 1 is attached in this manner is dropped, and an impact is applied to the developer container 2, the shock absorbing members 13 of the packing member 1 deform to absorb the impact.

As shown in FIG. 10A, when an impact in the developer-container attaching direction (Z direction) is applied, the shock absorbing members 13 deform in a state in which the surface 111*a* of the base portion 111 of the first supporting part 11 is in contact with the distal end portion 211*a* of the projecting wall 211 of the attachment part 21. As a result, the developer container 2 moves in the dropping direction, and the impact is absorbed. After the developer container 2 moves in the dropping direction, the gap G1 between the surface 121*a* of the base portion 121 of the second supporting part 12 and the distal end portion 21*a* of the attachment part 21 is reduced to a gap g1, but the surface 121*a* and the distal end portion 21*a* do not touch each other.

In other words, because the first supporting part 11 and the second supporting part 12 move relative to each other in the impact direction (Z direction) via the shock absorbing members 13, the impact in the developer-container attaching direction (Z direction) is absorbed. By determining the number of shock absorbing members 13 according to the weight of the developer container 2, it is possible to allow the shock absorbing members 13 to deform elastically, not plastically.

When an impact in the direction (X-Y direction) intersecting the developer-container attaching direction is applied, as shown in FIG. 10B, the shock absorbing members 13 deform in a state in which the projecting wall 211 of the attachment part 21 is sandwiched between the first projecting portion 112 and the second projecting portion 113 of the first supporting part 11 and thus is secured in the X-Y direction. As a result, the developer container 2 moves in the dropping direction (X-Y direction), and the impact is absorbed. Although the gap G2 between the fourth projecting portion 123 of the second supporting part 12 and the outer surface 21*b* of the attachment part 21 is reduced to a gap g2, the fourth projecting portion 123 and the outer surface 21*b* do not touch each other.

In other words, because the first supporting part 11 and the second supporting part 12 move relative to each other in the impact direction (X-Y direction) via the shock absorbing members 13, the impact in the direction (X-Y direction) intersecting the developer-container attaching direction is absorbed.

Modification 1

Figure 11:
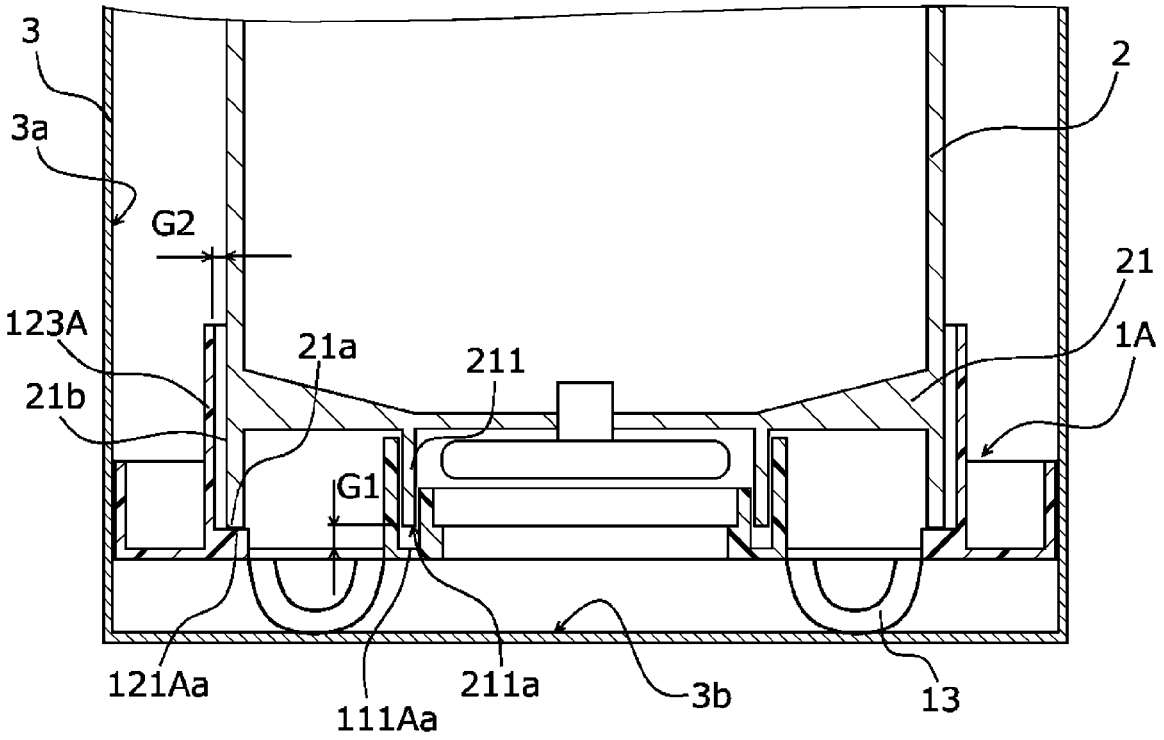
FIG. 11 is a schematic sectional view of a packing member according to modification 1, to which an attachment part of the developer container is attached.
Figure 12:
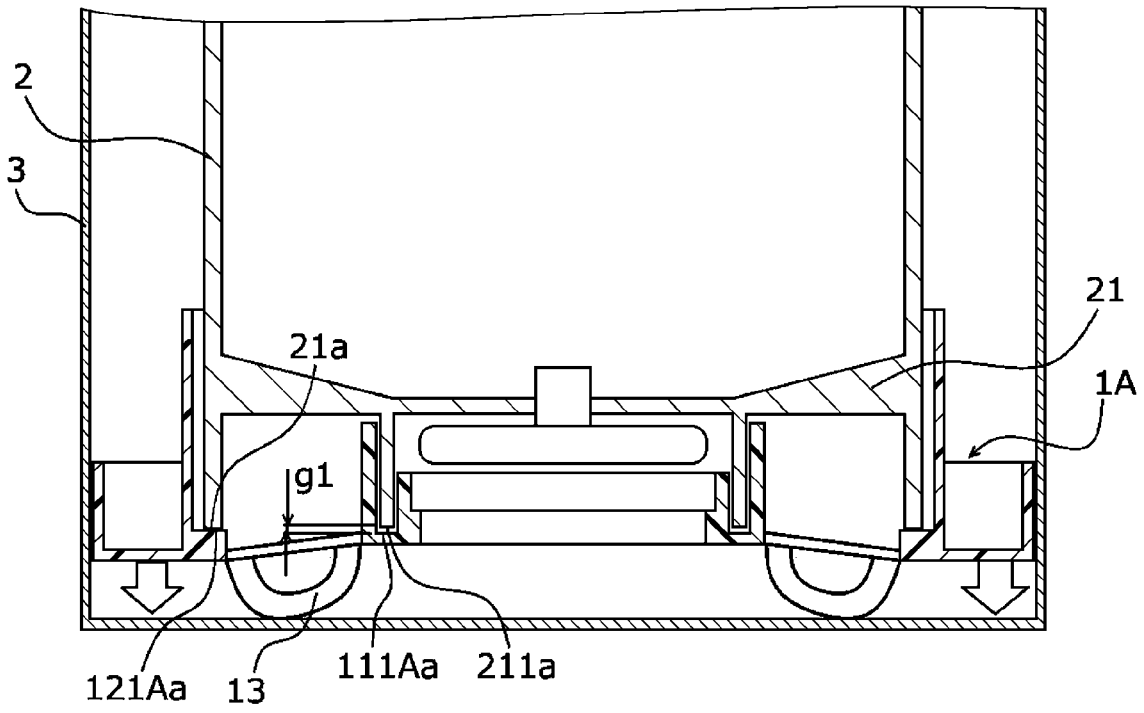
FIG. 12 shows how the packing member according to modification 1 absorbs an impact applied in the direction in which the developer container is attached.

FIG. 11 is a schematic sectional view of a packing member 1A according to modification 1, to which the attachment part 21 of the developer container 2 is attached. FIG. 12 shows how the packing member 1A absorbs an impact applied in the developer-container attaching direction.

In the packing member 1A according to modification 1, a surface 111Aa of a base portion 111A of a first supporting part 11A and a surface 121Aa of a base portion 121A of a second supporting part 12A have different heights in the developer-container attaching direction (Z direction).

More specifically, there is a gap G1 between the surface 111Aa of the base portion 111A of the first supporting part 11A and the distal end portion 211*a* of the projecting wall 211 of the attachment part 21 so that they do not touch each other. The projecting wall 211 of the attachment part 21 is sandwiched between projections 112Aa of a first projecting portion 112A and projections 113Aa of a second projecting portion 113A of the first supporting part 11A, thus being positioned in the direction (X-Y direction) intersecting the developer-container attaching direction.

The surface 121Aa of the base portion 121A of the second supporting part 12A is in contact with the distal end portion 21*a* of the attachment part 21 of the developer container 2. There is a gap G2 between the outer surface 21*b* of the attachment part 21 and a fourth projecting portion 123A of the second supporting part 12A so that they do not touch each other. The first supporting part 11A and the second supporting part 12A are connected to each other via the shock absorbing members 13.

As shown in FIG. 12, when an impact in the direction in which the developer container 2, to which the thus-configured packing member 1A is attached, is attached (Z direction) is applied, the shock absorbing members 13 deform in a state in which the surface 121Aa of the base portion 121A of the second supporting part 12A is in contact with the distal end portion 21*a* of the attachment part 21. As a result, the developer container 2 moves in the dropping direction, and the impact is absorbed. After the developer container 2 moves in the dropping direction, the gap G1 between the surface 111Aa of the base portion 111A of the first supporting part 11A and the distal end portion 211*a* of the projecting wall 211 of the attachment part 21 is reduced to a gap g1, but the surface 111Aa and the distal end portion 211*a* do not touch each other.

In other words, because the first supporting part 11A and the second supporting part 12A move relative to each other in the impact direction (Z direction) via the shock absorbing members 13, the impact in the developer-container attaching direction (Z direction) is absorbed.

As shown in FIG. 10B, when an impact in the direction (X-Y direction) intersecting the developer-container attaching direction is applied, the shock absorbing members 13 deform in a state in which the projecting wall 211 of the attachment part 21 is sandwiched between the first projecting portion 112A and the second projecting portion 113A of the first supporting part 11A and thus is secured in the X-Y direction. As a result, the developer container 2 moves in the dropping direction (X-Y direction), and the impact is absorbed.

Although the gap G2 between the fourth projecting portion 123A of the second supporting part 12A and the outer surface 21*b* of the attachment part 21 is reduced to a gap g2 (see FIG. 10B), the fourth projecting portion 123A and the outer surface 21*b* do not touch each other. Because the first supporting part 11A and the second supporting part 12A move relative to each other in the impact direction (X-Y direction) via the shock absorbing members 13, the impact in the direction (X-Y direction) intersecting the developer-container attaching direction is absorbed.

Modification 2

Figure 13:
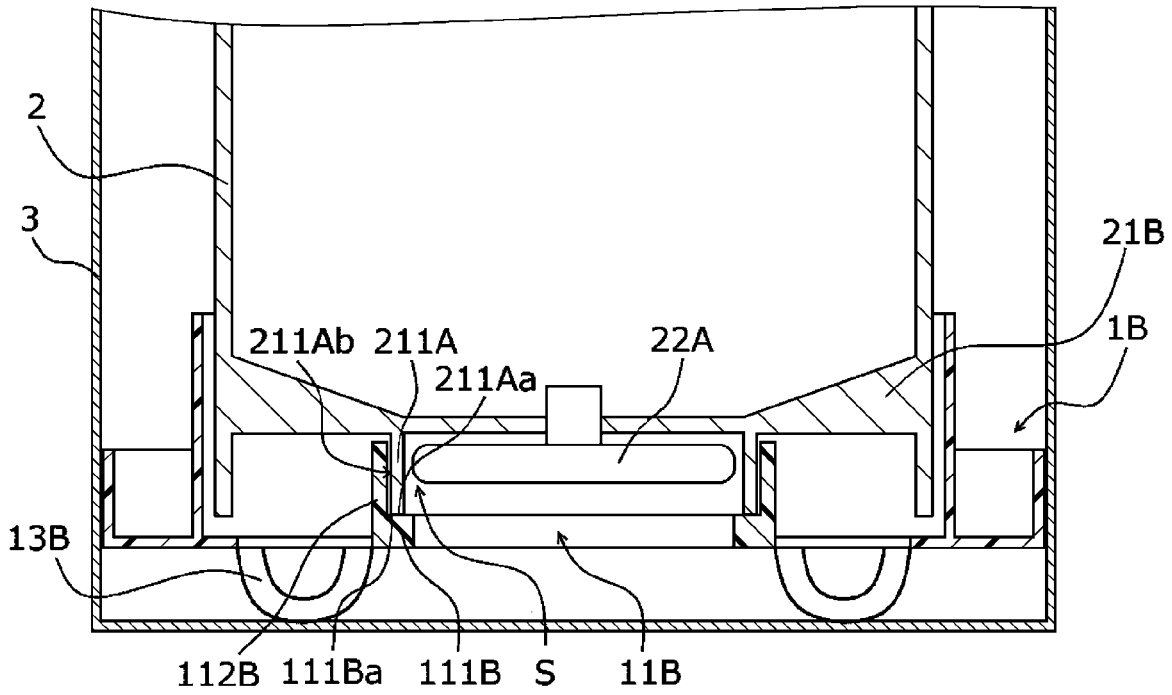
FIG. 13 is a schematic sectional view of a packing member according to modification 2, to which an attachment part of the developer container is attached.

FIG. 13 is a schematic sectional view of a packing member 1B according to modification 2, to which an attachment part 21A of the developer container 2 is attached. The packing member 1B according to modification 2 may have a shape conforming to the shape of a projecting wall 211A provided at the center of the attachment part 21A of the developer container 2 attached thereto.

As shown in FIG. 13, a first supporting part 11B of the packing member 1B has a first projecting portion 112B projecting in the Z direction from the outer side of a base portion 111B in the X-Y direction.

A coupling 22A having a large diameter is provided on the inner side of the projecting wall 211A of the attachment part 21A of the developer container 2. When the first projecting portion 112B cannot enter a space S inside the projecting wall 211A, the first supporting part 11B of the packing member 1B comes into contact with an outer surface 211Ab of the projecting wall 211A to hold the attachment part 21A.

When an impact in the developer-container attaching direction (Z direction) is applied to the packing member 1B, shock absorbing members 13B deform in a state in which a surface 111Ba of the base portion 111B of the first supporting part 11B is in contact with a distal end portion 211Aa of the projecting wall 211A of the attachment part 21A, thus absorbing the impact.

When an impact in the direction (X-Y direction) intersecting the developer-container attaching direction is applied, the shock absorbing members 13B deform in a state in which the outer surface 211Ab of the projecting wall 211A is in contact with the first projecting portion 112B of the first supporting part 11B and thus is secured in the X-Y direction, thus absorbing the impact.

Modification 3

Figure 14:
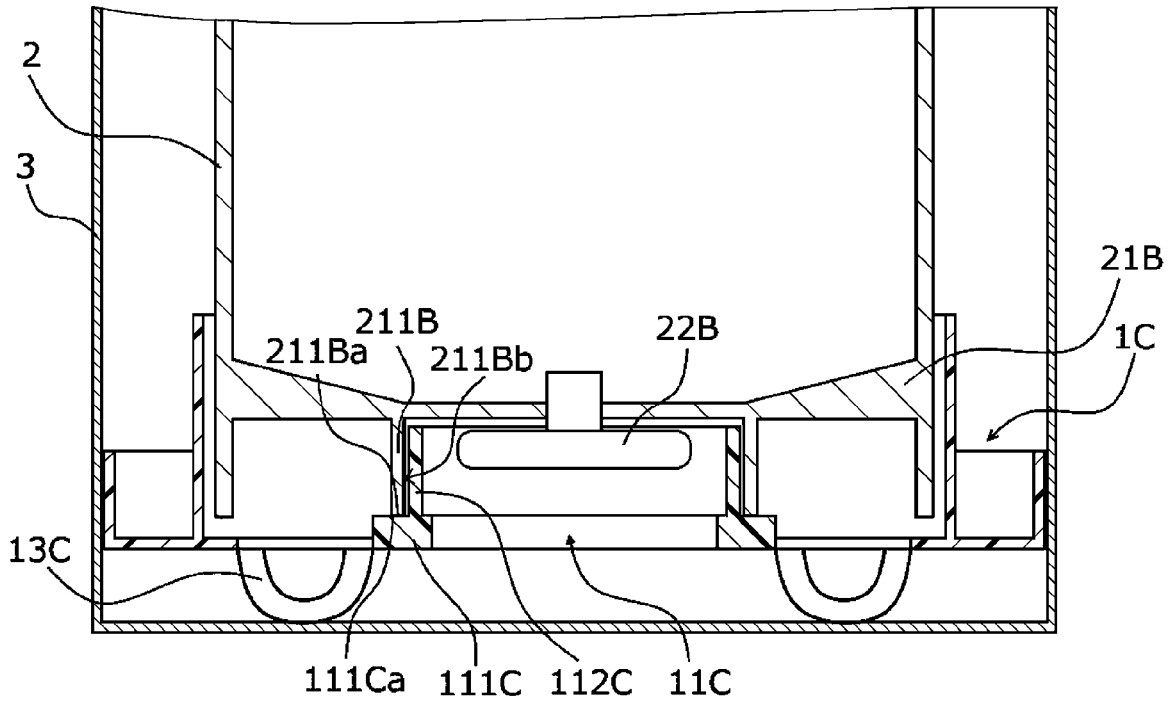
FIG. 14 is a schematic sectional view of a packing member according to modification 3, to which an attachment part of the developer container is attached.

FIG. 14 is a schematic sectional view of a packing member 10 according to modification 3, to which an attachment part 21B of the developer container 2 is attached.

As shown in FIG. 14, a first supporting part 11C of the packing member 10 has a first projecting portion 112C projecting in the Z direction from the inner side of a base portion 111C in the X-Y direction.

When a coupling 22B having a small diameter is provided on the inner side of a projecting wall 211B of the attachment part 21B of the developer container 2, the first projecting portion 112C of the first supporting part 11C of the packing member 10 enters a space S inside the projecting wall 211B and comes into contact with an inner surface 211Bb of the projecting wall 211B to hold the attachment part 21B.

When an impact in the developer-container attaching direction (Z direction) is applied to the packing member 10, shock absorbing members 13C deform in a state in which a surface 111Ca of the base portion 111C of the first supporting part 11C is in contact with a distal end portion 211Ba of the projecting wall 211B of the attachment part 21B, thus absorbing the impact.

When an impact in the direction (X-Y direction) intersecting the developer-container attaching direction is applied, the shock absorbing members 13C deform in a state in which the inner surface 211Bb of the projecting wall 211B is in contact with the first projecting portion 112C of the first supporting part 11B and thus is secured in the X-Y direction, thus absorbing the impact.

Although the developer container 2 has been described as an example of an article to be packed in the exemplary embodiment, the article to be packed secured by the packing member 1 does not need to be the developer container 2. The article may be anything having, at an end thereof, a tubular member to which the packing member is attached.

The shock absorbing members 13 in the exemplary embodiment, which connect between the first supporting part 11 and the second supporting part 12, do not need to be protruding bridges. The shock absorbing members 13 may be anything that can be more easily deformed by an external force than the first supporting part 11 and the second supporting part 12 and may have, for example, a film shape as a whole.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A packing member attached to an article to be packed, which is accommodated in a package box, to absorb an impact applied to the article, the packing member comprising:

a first supporting part;

a second supporting part; and a shock absorbing member connected to the first supporting part and the second supporting part, wherein one of the first supporting part and the second supporting part is disposed so as to be partially in contact with the article in a state in which an impact is not applied, and when an impact is applied, the shock absorbing member deforms to absorb the impact, wherein the shock absorbing member is provided between the first supporting part and the second supporting part so as to extend in a direction parallel to a direction in which the article is attached, the direction being opposite to the direction in which the article is located, wherein the first supporting part and the second supporting part have a first surface and a second surface, respectively, facing an end of the article in the direction in which the article is attached, and the shock absorbing member is provided so as to connect between the first and second surfaces, wherein the second supporting part supports a part of the article further on the outside than the first supporting part in a direction intersecting the direction in which the article is attached, one of the first surface of the first supporting part and the second surface of the second supporting part is in contact with the end of the article in the direction in which the article is attached, and the other of the first surface of the first supporting part and the second surface of the second supporting part is not in contact with the end of the article in the direction in which the article is attached.

2. The packing member according to claim 1, wherein the shock absorbing member is provided so as to connect between parts, not the entirety, of the first and second surfaces.

3. The packing member according to claim 1, wherein the distance between the first supporting part and the end of the article in the direction in which the article is attached and the distance between the second supporting part and the end of the article in the direction in which the article is attached are different.

4. The packing member according to claim 1, wherein the first surface of the first supporting part is in contact with the end of the article in the direction in which the article is attached, and the second surface of the second supporting part is not in contact with the end of the article in the direction in which the article is attached.

5. The packing member according to claim 1, wherein the second surface of the second supporting part is in contact with the end of the article in the direction in which the article is attached, and the first surface of the first supporting part is not in contact with the end of the article in the direction in which the article is attached.

6. The packing member according to claim 1, wherein the first supporting part is in contact with the article in the direction intersecting the direction in which the article is attached, and the second supporting part is not in contact with the article in the direction intersecting the direction in which the article is attached.

7. The packing member according to claim 1, wherein the shock absorbing member includes a plurality of shock absorbing members that are connected to the first supporting part and the second supporting part at ends thereof and that form bridges protruding in the direction in which the article is attached, the direction being opposite to the direction in which the article is located.

8. The packing member according to claim 7, wherein the protruding bridges are bent in the direction in which the article is attached, forming a substantially U shape.

9. A packing member attached to an article to be packed, which is accommodated in a package box, to absorb an impact applied to the article, the packing member comprising:

a first supporting part;

a second supporting part; and a shock absorbing member connected to the first supporting part and the second supporting part, wherein one of the first supporting part and the second supporting part is disposed so as to be partially in contact with the article in a state in which an impact is not applied, and when an impact is applied, the shock absorbing member deforms to absorb the impact, wherein an exterior part of the second supporting part fits in an inner surface of the package box, a central part of the second supporting part is in contact with the article in a direction intersecting a direction in which the article is attached, and a portion near an outer circumferential part of the second supporting part is not in contact with the article in the direction intersecting the direction in which the article is attached.

10. A packing member attached to an article to be packed, which is accommodated in a package box, to absorb an impact applied to the article, the packing member comprising:

a first supporting part;

a second supporting part; and a shock absorbing member connected to the first supporting part and the second supporting part, wherein one of the first supporting part and the second supporting part is disposed so as to be partially in contact with the article in a state in which an impact is not applied, and when an impact is applied, the shock absorbing member deforms to absorb the impact, wherein the first supporting part has a projection that projects in a direction intersecting a direction in which the article is attached and that is in contact with the article.

11. The packing member according to claim 1, wherein, when an impact in a direction in which the article is attached is applied, both the first supporting part and the second supporting part deform and come into contact with the article.

12. The packing member according to claim 1, wherein, when an impact in a direction intersecting the direction in which the article is attached is applied, both the first supporting part and the second supporting part deform and come into contact with the article.

13. A packing member attached to an article to be packed, which is accommodated in a package box, to absorb an impact applied to the article, the packing member comprising:

a first supporting part;

a second supporting part; and a shock absorbing member connected to the first supporting part and the second supporting part, wherein one of the first supporting part and the second supporting part is disposed so as to be partially in contact with the article in a state in which an impact is not applied, and when an impact is applied, the shock absorbing member deforms to absorb the impact, wherein the article is a developer container attached to an image forming apparatus, one end of the developer container, on which a driving-force transmitting part is provided, is held by the first supporting part, and another end of the developer container is held by the package box.

14. The packing member according to claim 1, wherein the first supporting part, the second supporting part, and the shock absorbing member are formed of synthetic resin, as a single component.

15. A packing member attached to an article to be packed, which is accommodated in a package box, to absorb an impact applied to the article, the packing member comprising:

first supporting means;

second supporting means; and shock absorbing means connected to the first supporting means and the second supporting means, wherein one of the first supporting means and the second supporting means is disposed so as to be partially in contact with the article in a state in which an impact is not applied, and when an impact is applied, the shock absorbing means deforms to absorb the impact, wherein the first supporting means has a projection that projects in a direction intersecting a direction in which the article is attached and that is in contact with the article.

* * * * *